US011585266B2

(12) United States Patent
Asakawa

(10) Patent No.: US 11,585,266 B2
(45) Date of Patent: Feb. 21, 2023

(54) VARIABLE GEOMETRY MECHANISM AND TURBOCHARGER

(71) Applicant: IHI Corporation, Tokyo (JP)

(72) Inventor: Takao Asakawa, Tokyo (JP)

( * ) Notice: Subject to any disclaimer, the term of this patent is extended or adjusted under 35 U.S.C. 154(b) by 1 day.

(21) Appl. No.: 17/221,843

(22) Filed: Apr. 5, 2021

(65) Prior Publication Data

US 2021/0222614 A1 Jul. 22, 2021

Related U.S. Application Data

(63) Continuation of application No. PCT/JP2019/030040, filed on Jul. 31, 2019.

(30) Foreign Application Priority Data

Oct. 9, 2018 (JP) ..... JP2018-191070

(51) Int. Cl.
*F02B 37/24* (2006.01)
*F01D 17/16* (2006.01)
*F02B 39/00* (2006.01)

(52) U.S. Cl.
CPC ..... *F02B 37/24* (2013.01); *F01D 17/16* (2013.01); *F02B 39/00* (2013.01);
(Continued)

(58) Field of Classification Search
CPC ..... F02B 37/24; F02B 39/00; F01D 17/16; F01D 25/24; F01D 17/165; F05D 2220/40; F05D 2240/128; F05D 2260/60
(Continued)

(56) References Cited

U.S. PATENT DOCUMENTS 11,131,238 B2 * 9/2021 Ramb ..... F01D 17/165
2003/0077167 A1 4/2003 Jinnai et al.
(Continued)

FOREIGN PATENT DOCUMENTS

CN 101035973 9/2007
CN 102383872 3/2012
(Continued)

OTHER PUBLICATIONS

International Search Report dated Sep. 10, 2019 for PCT/JP2019/030040.
(Continued)

*Primary Examiner* — J. Todd Newton
(74) *Attorney, Agent, or Firm* — Sofi Patent & Law Firm

(57) ABSTRACT

A variable geometry mechanism include an annular nozzle ring, a drive ring rotatable about a central axis of the nozzle ring, wherein the drive ring includes, a plurality of attachment portions formed on a surface of the drive ring and a self-stopper projecting from the surface of the drive ring on which the attachment portions are formed, wherein the self-stopper is located radially inward from the attachment portions so as to be closer to the central axis of the nozzle ring, a plurality of nozzle vanes rotatably coupled to the nozzle ring and a plurality of nozzle link plates extending from the nozzle ring to the drive ring, wherein the self-stopper is configured to regulate a moving range of at least one of the nozzle link plates during the rotation of the drive ring.

20 Claims, 6 Drawing Sheets

(52) U.S. Cl.
CPC .... *F05D 2220/40* (2013.01); *F05D 2240/128* (2013.01); *F05D 2260/60* (2013.01)

(58) Field of Classification Search
USPC ..... 415/159
See application file for complete search history.

(56) References Cited

U.S. PATENT DOCUMENTS

| | | | | |
|---|---|---|---|---|
| 2005/0252210 | A1 | 11/2005 | Shiraishi et al. | |
| 2008/0035112 | A1 | 2/2008 | Yamaguchi et al. | |
| 2010/0014961 | A1* | 1/2010 | Boning | F01D 17/165 415/160 |
| 2010/0310359 | A1* | 12/2010 | Valin | F01D 17/165 137/15.01 |
| 2013/0004298 | A1* | 1/2013 | Ramb | F02B 37/24 415/148 |
| 2014/0147254 | A1 | 5/2014 | Tashiro et al. | |
| 2014/0178181 | A1 | 6/2014 | Tashiro et al. | |
| 2017/0022891 | A1 | 1/2017 | Arai et al. | |
| 2018/0038272 | A1 | 2/2018 | Tashiro et al. | |
| 2018/0363493 | A1 | 12/2018 | Asakawa et al. | |
| 2019/0153943 | A1 | 5/2019 | Asakawa et al. | |
| 2020/0123967 | A1* | 4/2020 | Ramb | F02B 37/24 |

FOREIGN PATENT DOCUMENTS

| | | | | |
|---|---|---|---|---|
| CN | 103649491 | | 3/2014 | |
| CN | 103649492 | | 3/2014 | |
| CN | 105723068 | | 6/2016 | |
| DE | 19731715 | A1 * | 1/1998 | F01D 17/165 |
| EP | 1564380 | A1 * | 8/2005 | F01D 17/165 |
| EP | 1674668 | | 6/2006 | |
| JP | H10-037754 | | 2/1998 | |
| JP | 2002-256879 | | 9/2002 | |
| JP | 2004-156592 | | 6/2004 | |
| JP | 2006-177318 | | 7/2006 | |
| JP | 2012-017705 | | 1/2012 | |
| JP | 2013-072401 | | 4/2013 | |
| JP | 2013-512387 | | 4/2013 | |
| JP | 2017-067051 | | 4/2017 | |
| WO | 2006/038599 | | 4/2006 | |
| WO | 2011/068267 | | 6/2011 | |
| WO | WO-2011071422 | A1 * | 6/2011 | F01D 17/165 |
| WO | 2013/047123 | | 4/2013 | |
| WO | 2013/047153 | | 4/2013 | |
| WO | 2015/092843 | | 6/2015 | |
| WO | 2017/150450 | | 9/2017 | |
| WO | 2018/037807 | | 3/2018 | |

OTHER PUBLICATIONS

International Preliminary Report on Patentability with Written Opinion dated Apr. 22, 2021 for PCT/JP2019/030040.

* cited by examiner

VARIABLE GEOMETRY MECHANISM AND TURBOCHARGER

CROSS-REFERENCE TO RELATED APPLICATIONS

This application is a continuation application of PCT Application No. PCT/JP2019/030040, filed on Jul. 31, 2019, which claims the benefit of priority from Japanese Patent Application No. 2018-191070, filed on Oct. 9, 2018, the entire contents of which are incorporated herein by reference.

BACKGROUND

A variable geometry mechanism is known which includes a plate, a drive ring that is disposed rotatable relative to the plate, and nozzle link plates that are attached to the plate and the drive ring. For example, in such a mechanism described in Japanese Unexamined Patent Publication No. 2006-177318, an end of each nozzle link plate is fit into a recess formed in an inner circumferential surface of the drive ring. When the drive ring rotates relative to the plate, each nozzle link plate rotates about a pin. When this rotation is transmitted to the pin, a nozzle vane connected to the pin rotates together with the nozzle link plate and the pin.

SUMMARY

An example variable geometry mechanism disclosed herein includes an annular plate including a first surface and a second surface opposite the first surface, and having a plurality of bearing holes formed therein, a drive ring including a third surface facing the same direction as the first surface and a fourth surface opposite the third surface, and rotatable about a central axis of the plate, a plurality of nozzle vanes each including a nozzle shaft having a first end and a second end, and a nozzle body formed at the first end, each nozzle vane being attached to the plate such that the nozzle shaft is inserted through each bearing hole and the second end projects from the second surface, and a plurality of nozzle link plates disposed on the second surface of the plate and on the fourth surface of the drive ring, each nozzle link plate including a base end positioned on the second surface and a distal end positioned on the fourth surface. The drive ring includes a body portion having the third surface and the fourth surface, a plurality of attachment portions formed on the fourth surface and projecting from the fourth surface, and a self-stopper formed on the fourth surface and projecting from the fourth surface. The base end of the nozzle link plate is attached to the second end of the nozzle shaft. The distal end of the nozzle link plate is movably attached to each attachment portion. The self-stopper is disposed between one of the bearing holes and one of the attachment portions in a radial direction of the plate, and regulates a moving range of the nozzle link plates.

An example turbocharger disclosed herein includes the example variable geometry mechanism, and a bearing housing to which the variable geometry mechanism is attached. The bearing housing includes an attachment surface facing the nozzle link plates of the variable geometry mechanism, and a fully open stopper formed on the attachment surface and projecting from the attachment surface. The fully open stopper regulates the moving range of the nozzle link plates. The moving range of the nozzle link plates regulated by the fully open stopper is smaller than the moving range of the nozzle link plates regulated by the self-stopper.

DETAILED DESCRIPTION

Figure 1:
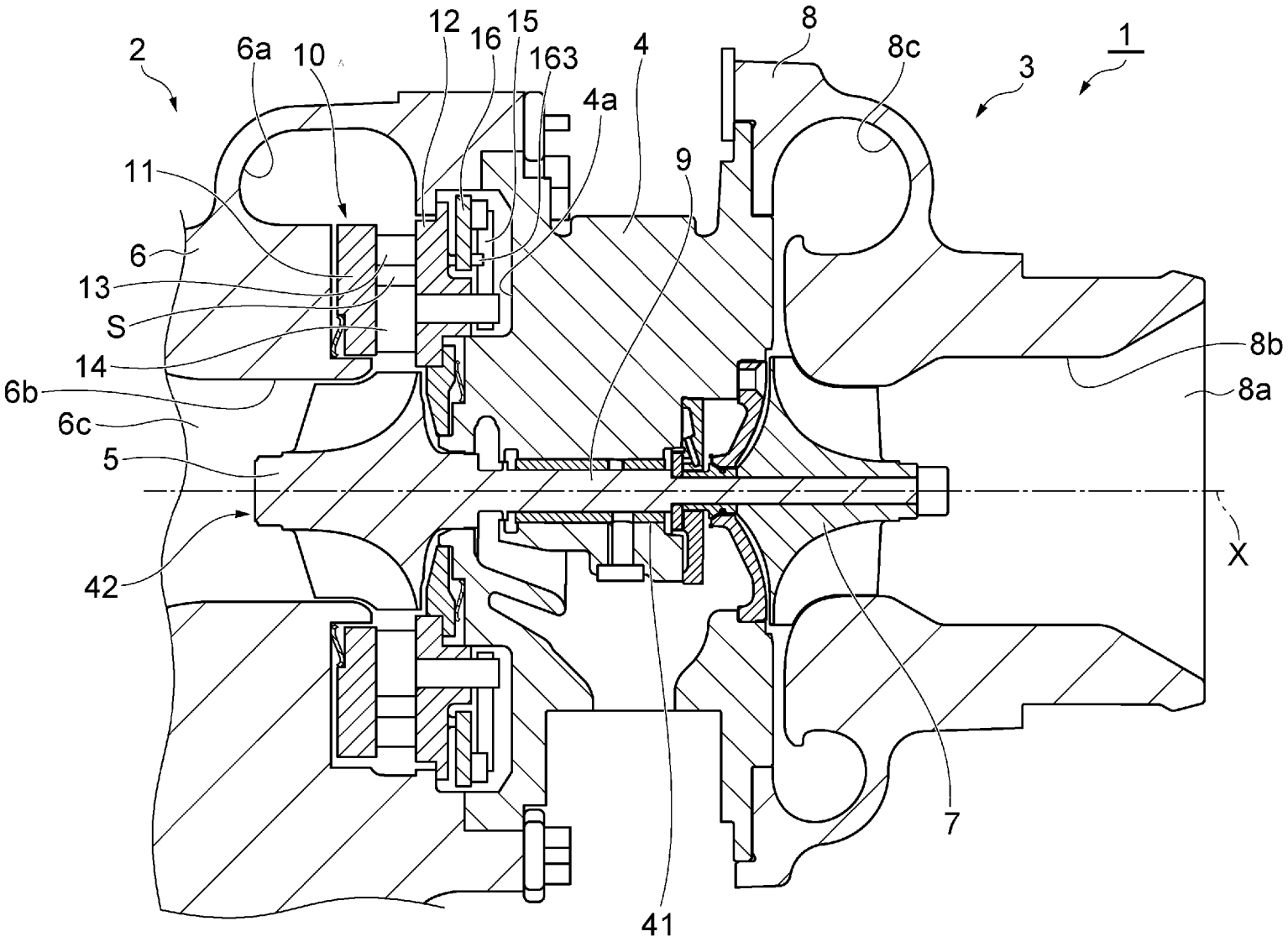
FIG. 1 is a cross-sectional view illustrating an example turbocharger.

An example variable geometry mechanism may include an annular plate including a first surface and a second surface opposite the first surface, and having a plurality of bearing holes formed therein, a drive ring including a third surface facing the same direction as the first surface and a fourth surface opposite the third surface, and rotatable about a central axis of the plate, a plurality of nozzle vanes each including a nozzle shaft having a first end and a second end, and a nozzle body formed at the first end, each nozzle vane being attached to the plate such that the nozzle shaft is inserted through each bearing hole and the second end projects from the second surface, and a plurality of nozzle link plates disposed on the second surface of the plate and on the fourth surface of the drive ring, each nozzle link plate including a base end positioned on the second surface and a distal end positioned on the fourth surface. The drive ring includes a body portion having the third surface and the fourth surface, a plurality of attachment portions formed on the fourth surface and projecting from the fourth surface, and a self-stopper formed on the fourth surface and projecting from the fourth surface. The base end of the nozzle link plate is attached to the second end of the nozzle shaft. The distal end of the nozzle link plate is movably attached to each attachment portion. The self-stopper is disposed between one of the bearing holes and one of the attachment portions in a radial direction of the plate, and regulates a moving range of the nozzle link plates.

In some examples, the drive ring is rotatable about the axis of the plate. Each nozzle vane is attached to the plate such that the nozzle shaft is inserted through each bearing hole of the plate and the second end projects from the second surface. The drive ring has a plurality of attachment portions that projects from the fourth surface. The base end of the nozzle link plate is attached to the second end of the nozzle shaft, and the distal end of the nozzle link plate is movably attached to each attachment portion. When the drive ring rotates about the axis of the plate, the distal end of the nozzle link plate attached to the attachment portion moves along a circumferential direction of the drive ring with the rotation of the drive ring. The nozzle link plate thus rotates about a longitudinal axis of the nozzle shaft. When the nozzle link plate rotates, the nozzle shaft attached to the base end of the nozzle link plate rotates and the nozzle body formed at the first end of the nozzle shaft rotates. The drive ring has the self-stopper which projects from the fourth surface and is disposed between one of the bearing holes and one of the attachment portions in the radial direction of the plate. Thus, when the rotation of the drive ring exceeds a predetermined range, the nozzle link plate abuts against the self-stopper. As a result, the rotation of the nozzle link plate is regulated by the self-stopper. Additionally, the nozzle link plate remains in contact with the attachment portion of the drive ring.

In some examples, the self-stopper may be integrally formed with the body portion by half blanking the body portion with a press. Accordingly, the number of components of the variable geometry mechanism can be reduced.

In some examples, the self-stopper may have a height that is less than a thickness of the nozzle link plate.

An example turbocharger includes the variable geometry mechanism, and a bearing housing to which the variable geometry mechanism is attached. The bearing housing includes an attachment surface facing the nozzle link plates of the variable geometry mechanism, and a fully open stopper formed on the attachment surface and projecting from the attachment surface. The fully open stopper regulates the moving range of the nozzle link plates. The moving range of the nozzle link plates regulated by the fully open stopper is smaller than the moving range of the nozzle link plates regulated by the self-stopper. After the variable geometry mechanism is attached to the bearing housing, the nozzle link plates abut against the fully open stopper before abutting against the self-stopper. The accuracy of position of the self-stopper thus does not affect the function of the turbocharger. Consequently, the accuracy of position of the self-stopper can be relaxed compared to the accuracy of position of the full-open stopper.

Hereinafter, with reference to the drawings, the same elements or similar elements having the same function are denoted by the same reference numerals, and redundant description will be omitted.

An example turbocharger 1 shown in FIG. 1 is, for example, a turbocharger for a ship or a vehicle. The turbocharger 1 compresses air supplied to an internal combustion engine by using exhaust gas discharged from the internal combustion engine. As shown in FIG. 1, the turbocharger 1 includes a turbine 2, a compressor 3, and a bearing housing 4 which is formed between the turbine 2 and the compressor 3. The turbine 2 has a turbine wheel 5 that has an axis of rotation X, and a turbine housing 6 that accommodates the turbine wheel 5. The turbine housing 6 has a turbine scroll channel 6*a* that extends in a circumferential direction (circumferential direction about the axis of rotation X) around the turbine wheel 5. The compressor 3 has a compressor wheel 7 and a compressor housing 8 that accommodates the compressor wheel 7. The compressor housing 8 has a compressor scroll channel 8*c* that extends in the circumferential direction around the compressor wheel 7.

The turbine wheel 5 is mounted on a first end of a rotating shaft 9. The compressor wheel 7 is mounted on a second end of the rotating shaft 9. The bearing housing 4 is disposed between the turbine 2 and the compressor 3 in a direction of the axis of rotation X. The bearing housing 4 is adjacent the turbine 2 and the compressor 3 in the direction of the axis of rotation X. The rotating shaft 9 is supported by the bearing housing 4 via a bearing 41. The rotating shaft 9 is rotatable relative to the bearing housing 4. The rotating shaft 9, the turbine wheel 5, and the compressor wheel 7 rotate about the axis of rotation X as an integrated rotating body 42.

The turbine housing 6 includes an inlet 6*s* through which exhaust gas flows into the turbine scroll channel 6*a*, an outlet channel 6*b* that communicates with the turbine scroll channel 6*a*, and an outlet 6*c* through which the exhaust gas flows out from the outlet channel 6*b*. The turbine wheel 5 is disposed inside the outlet channel 6*b*. The exhaust gas discharged from the internal combustion engine flows into the turbine scroll channel 6*a* through the exhaust gas inlet. The exhaust gas then flows into the outlet channel 6*b* to rotate the turbine wheel 5. Thereafter, the exhaust gas flows out of the turbine housing 6 through the outlet 6*c*.

The compressor housing 8 includes an inlet port 8*a* into which air is sucked, an inlet channel 8*b* that communicates with the compressor scroll channel 8*c*, and an outlet port 8*s* through which compressed air is discharged from the compressor scroll channel 8*c*. The compressor wheel 7 is disposed inside the inlet channel 8*b*. When the turbine wheel 5 rotates as described above, the rotating shaft 9 and the compressor wheel 7 rotate. The rotating compressor wheel 7 compresses the air drawn in from the inlet port 8*a* and the inlet channel 8*b*. The compressed air passes through the compressor scroll channel 8*c* and is then discharged from the outlet port 8*s*. The compressed air discharged from the outlet port is supplied to the internal combustion engine.

Figure 2:
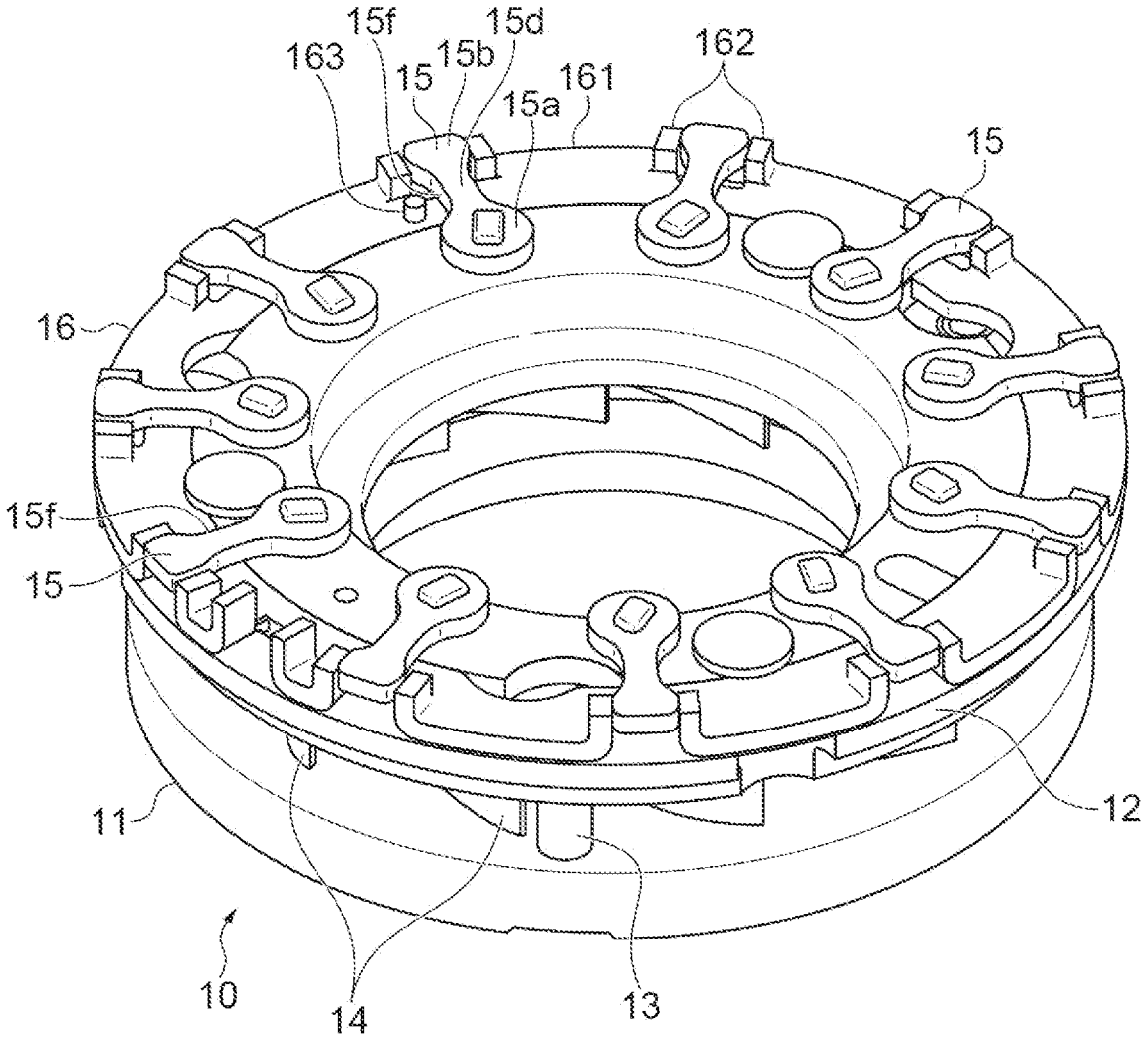
FIG. 2 is a perspective view of an example variable geometry mechanism.

A variable geometry turbine, such as the example turbine 2 illustrated in FIG. 1, will now be described in further detail. The turbocharger 1 includes an example variable geometry mechanism 10 that is attached to the bearing housing 4. As shown in FIGS. 1 and 2, the variable geometry mechanism 10 has a clearance control (CC) plate 11, a nozzle ring (plate) 12 that is disposed so as to face the CC plate 11, and a plurality (three, for example) of clearance control (CC) pins 13 that connect the CC plate 11 to the nozzle ring 12. The variable geometry mechanism 10 further includes a plurality (11, for example) of nozzle vanes 14 that is attached to the nozzle ring 12, a plurality (11, for example) of nozzle link plates 15 that is disposed on a side of the nozzle ring 12 opposite that of the CC plate 11, and a drive ring 16 that rotates the nozzle link plates 15.

The CC plate 11 and the nozzle ring 12 each has an annular shape (ring shape) about the axis of rotation X. The CC plate 11 and the nozzle ring 12 surround the turbine wheel 5 in the circumferential direction. The CC plate 11 and the nozzle ring 12 are disposed between the turbine scroll channel 6*a* and the outlet channel 6*b*. The CC plate 11 and the nozzle ring 12 are disposed parallel to each other. The CC plate 11 and the nozzle ring 12 are separated from each other in the direction of the axis of rotation X. A connection channel S is formed between the CC plate 11 and the nozzle ring 12. The connection channel S connects the turbine scroll channel 6*a* to the outlet channel 6*b*. The CC plate 11 is disposed on a side of the nozzle ring 12 opposite that of the bearing housing 4.

Figure 3:
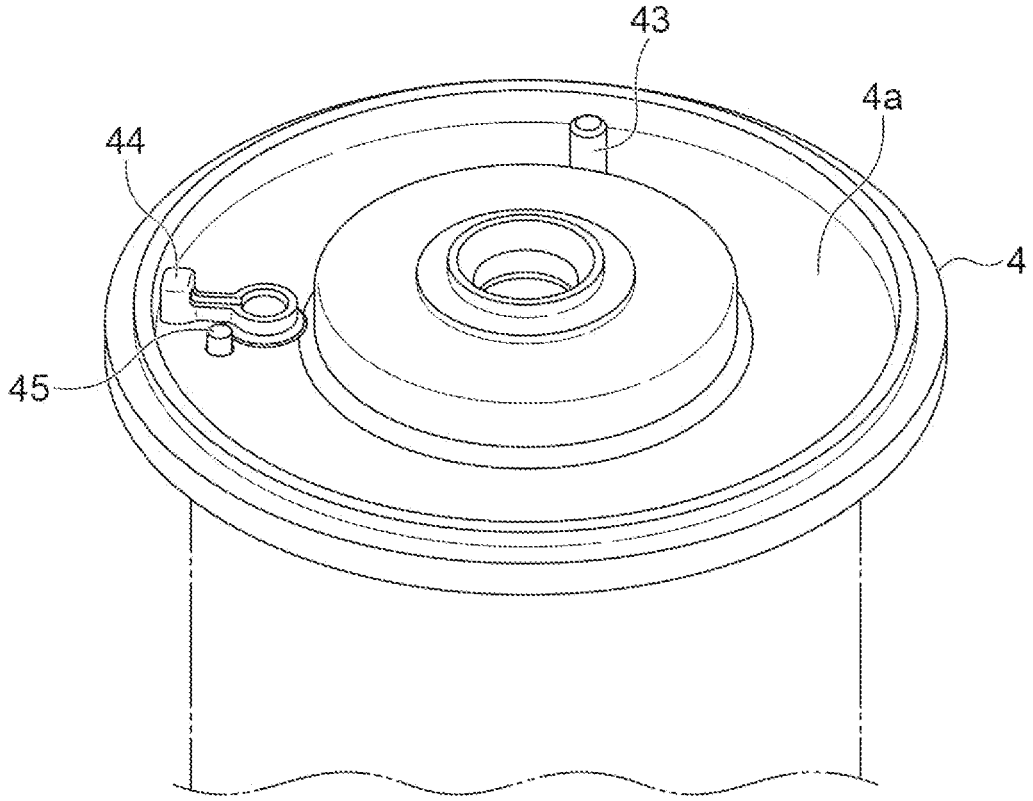
FIG. 3 is a perspective view of a bearing housing.

As shown in FIGS. 1 and 3, the bearing housing 4 includes an attachment surface 4*a* that faces the variable geometry mechanism 10. The variable geometry mechanism 10 is attached to the bearing housing 4. The nozzle link plates 15 face the attachment surface 4*a*. The attachment surface 4*a* includes a positioning member 43, a drive member 44, and a fully open stopper 45 that project from the attachment surface 4*a*.

The positioning member 43 is for positioning the variable geometry mechanism 10 with respect to the bearing housing 4. The drive member 44 is for rotationally driving the drive ring 16. The fully open stopper 45 projects to a position between a fifth surface 15*c* and a sixth surface 15*d* of each nozzle link plate 15 (see FIG. 5) when the variable geometry mechanism 10 is attached to the bearing housing 4. It should be noted that the positioning member 43, the drive member 44, and the fully open stopper 45 are omitted in FIG. 1.

Figure 4:
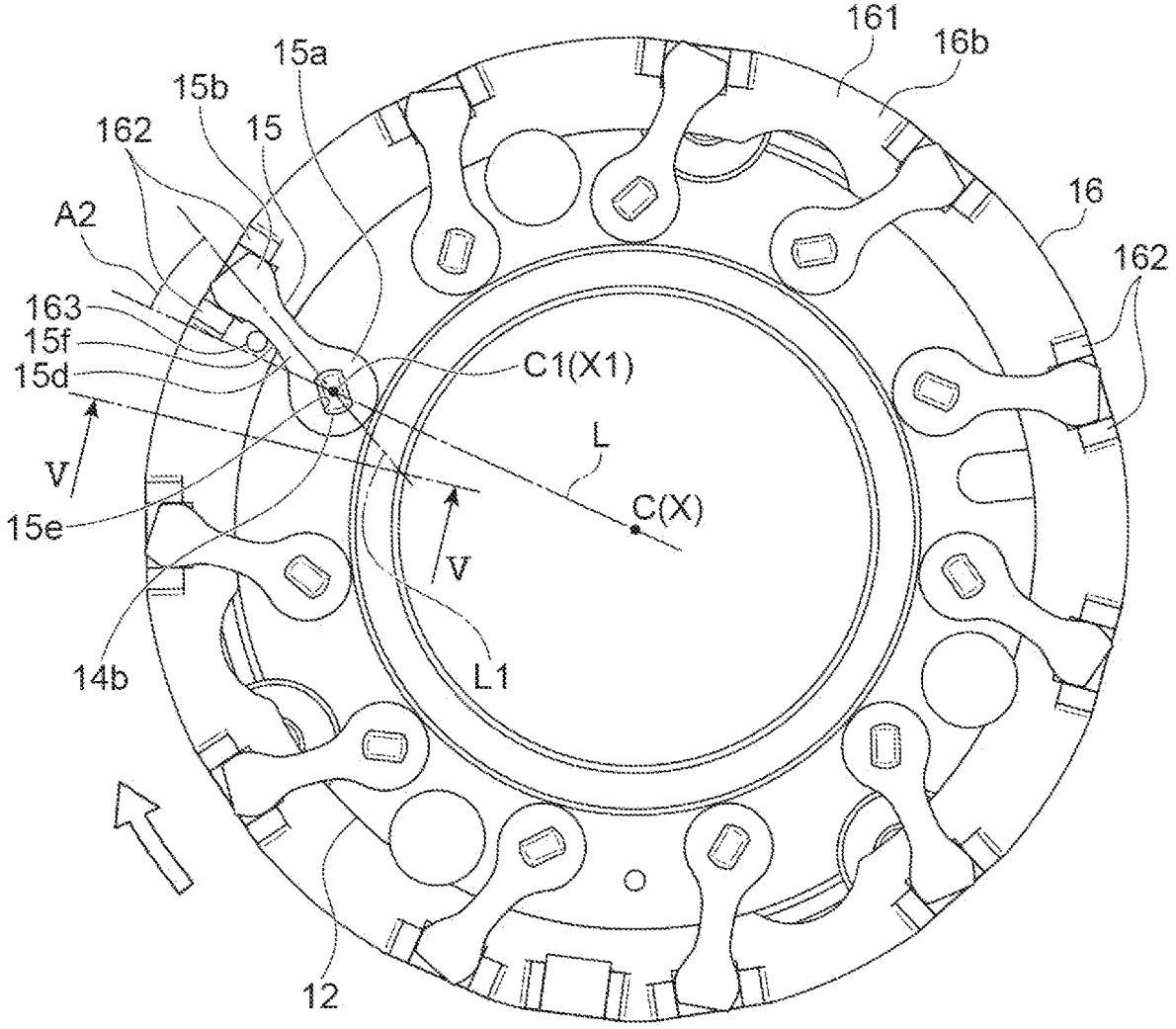
FIG. 4 is a plan view of the example variable geometry mechanism of FIG. 2.
Figure 5:
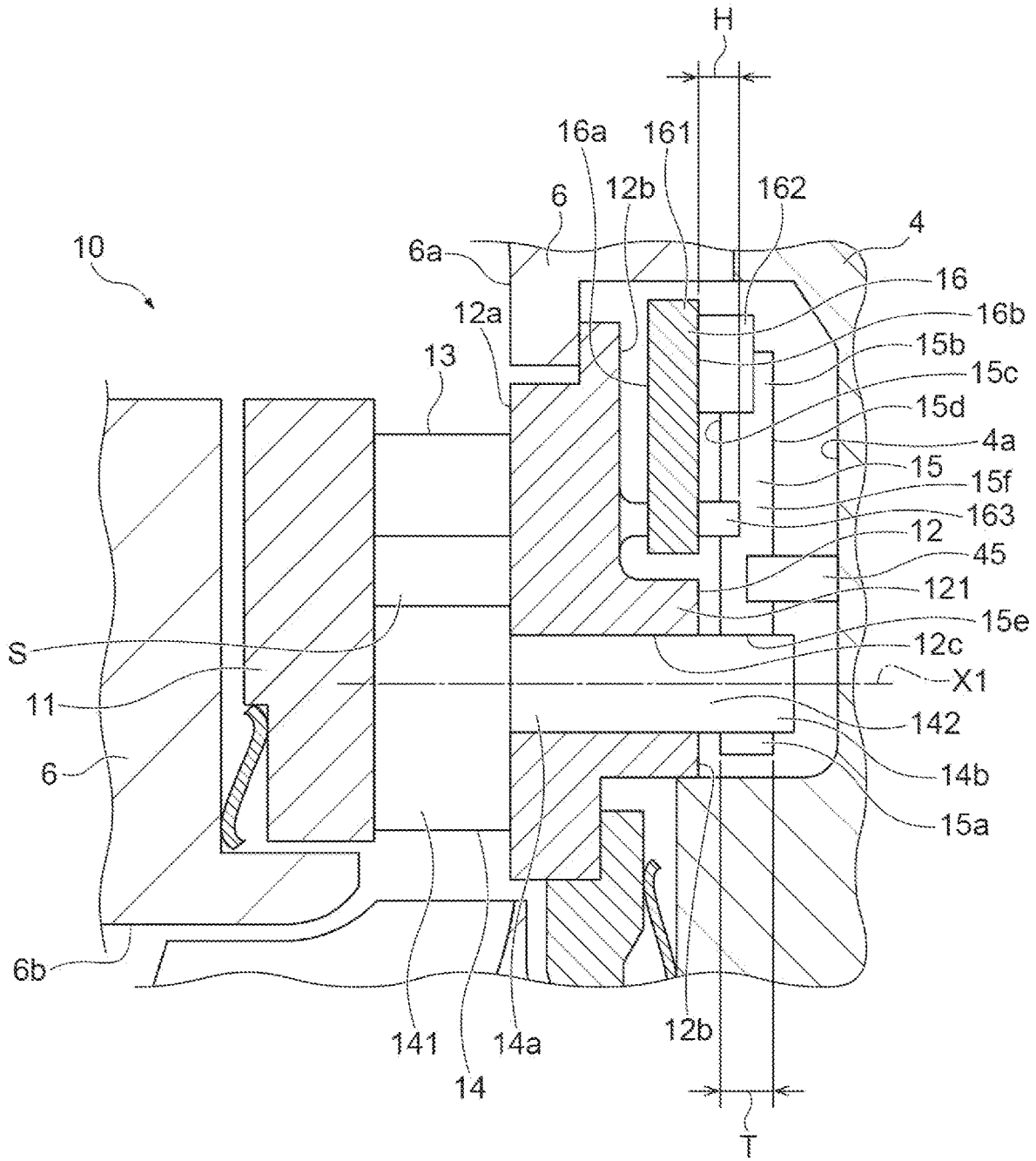
FIG. 5 is a cross-sectional view taken along line V-V of FIG. 4.

As shown in FIGS. 4 and 5, the nozzle ring 12 includes a first surface 12*a* that faces the CC plate 11 and a second surface 12*b* that is opposite the first surface 12*a*. The nozzle ring 12 has a projecting portion 121 that for us part of the second surface 12*b*. That is, the second surface 12*b* may include the entire surface of the nozzle ring 12 opposite the first surface 12*a*, including the projection portion 121. The projecting portion 121 has a cylindrical shape about the axis of rotation X. The projecting portion 121 has an outer diameter that is smaller than the outer diameter of the whole nozzle ring 12. The nozzle ring 12 has a plurality (11, for example) of bearing holes 12*c* that passes through the projecting portion 121. The plurality of bearing holes 12*c* are spaced equidistant from each other in the circumferential direction of the nozzle ring 12. The CC plate 11 and the nozzle ring 12 are connected to each other by the CC pins 13. The distance between the CC plate 11 and the nozzle ring 12 is defined by the CC pins 13. It should be noted that portions of the bearing housing 4 and the turbine 2 are shown in FIG. 5.

The plurality of nozzle vanes 14 are circumferentially located about the axis of rotation X. Each of the nozzle vanes 14 has a nozzle body 141 and a nozzle shaft 142 that projects from the nozzle body 141. The nozzle shaft 142 includes a first end 14*a* connected to the nozzle body 141 and a second end 14*b* opposite the first end 14*a*. The nozzle shafts 142 are inserted into the bearing holes 12*c* at the first surface 12*a* of the nozzle ring 12. The nozzle bodies 141 are disposed between the CC plate 11 and the nozzle ring 12 (to form the connection channel S). The nozzle shafts 142 extend through the nozzle ring 12 such that the second ends 14*b* of the nozzle shafts 142 project from the second surface 12*b* of the nozzle ring 12. The nozzle vanes 14 are thus attached to the nozzle ring 12.

The nozzle shafts 142 are supported by the nozzle ring 12. The nozzle shafts 142 are rotatable relative to (e.g., rotationally coupled to) the nozzle ring 12. The nozzle bodies 141 rotate with rotation of the nozzle shafts 142. The variable geometry mechanism 10 selectively adjusts the cross-sectional area of the connection channel S by rotating the nozzle bodies 141. As a result, the flow rate of the exhaust gas that flows into the outlet channel 6*b* from the turbine scroll channel 6*a* is controlled. The number of revolutions of the turbine wheel 5 is thus selectively controlled.

The drive ring 16 is located adjacent to and spaced apart from the second surface 12*b* of the nozzle ring 12. The drive ring 16 is annular (ring-shaped) around the axis of rotation X. The drive ring 16 surrounds the projecting portion 121 of the nozzle ring 12 in the circumferential direction. The drive ring 16 is rotatable about the axis of rotation X (axis of the nozzle ring 12). The drive ring 16 has a body portion 161, a plurality (11, for example) of attachment portions 162 that projects from the body portion 161, and a self-stopper 163 that projects from the body portion 161. The body portion 161 includes a third surface 16*a* that faces in the same direction as the first surface 12*a* of the nozzle ring 12 (the direction facing the CC plate 11) and a fourth surface 16*b* opposite the third surface 16*a*. The third surface 16*a* faces the second surface 12*b* of the nozzle ring 12. The fourth surface 16*b* and the second surface 12*b* of the nozzle ring 12 both face away from the CC plate 11.

The attachment portions 162 are formed on the fourth surface 16*b* and project from the fourth surface 16*b*. The attachment portions 162 are spaced equidistant from each other in the circumferential direction of the drive ring 16. Each of the attachment portions 162 has two attachment members, including a first attachment member 162*a* and a second attachment member 162*b*, that are separated from each other in the circumferential direction. The attachment portions 162 may be integrally formed with the body portion 161 at an outer peripheral portion of the body portion 161. In some examples, the attachment portions 162 are formed by bending the outer peripheral portion of the body portion 161.

The self-stopper 163 is formed on the fourth surface 16*b*. The self-stopper 163 projects from the fourth surface 16*b*. The self-stopper 163 projects, for example, to a position between the fifth surface 15*c* and the sixth surface 15*d* of the nozzle link plate 15. The self-stopper 163 projects, for example, to a position approximately halfway between the fifth surface 15*c* and the sixth surface 15*d* of the nozzle link plate 15. The self-stopper 163 may project, for example, more toward the fifth surface 15*c* than a position approximately halfway between the fifth surface 15*c* and the sixth surface 15*d* of the nozzle link plate 15. The self-stopper 163 has a height H that is, for example, less than a thickness T of the nozzle link plate 15. The height H of the self-stopper 163 is, for example, approximately half the thickness T of the nozzle link plate 15. The height H of the self-stopper 163 may be, for example, less than half the thickness T of the nozzle link plate 15. The self-stopper 163 is located inward of the attachment portions 162 in a radial direction (radial direction about the axis of rotation X). The self-stopper 163 is located radially inward of one of the attachment members (e.g., the first attachment member 162*a*) of the attachment portions 162 so as to be closer to a central axis X1 of the nozzle shaft 142. The self-stopper 163 is disposed between one of the bearing holes 12*c* and one of the attachment portions 162 in the radial direction of the nozzle ring 12. The self-stopper 163 is, for example, cylindrical. The self-stopper 163 is, for example, integrally formed with the body portion 161 by half blanking the body portion 161 with a press.

The nozzle link plates 15 are located adjacent to and spaced apart from the fourth surface 16*b* of the drive ring 16. The nozzle link plates 15 span and/or overlap the nozzle ring 12 and the drive ring 16 in the radial direction. The nozzle link plates 15 are bar-like. Each of the nozzle link plates 15 includes a base end 15*a* (e.g., a first end) that is positioned on the second surface 12*b* of the projecting portion 121 and a distal end 15*b* (e.g., a second end) that is positioned on the fourth surface 16*b* of the drive ring 16. The nozzle link plate 15 includes the fifth surface 15*c* and the sixth surface 15*d* opposite the fifth surface 15*c*. The fifth surface 15*c* faces the second surface 12*b* of the nozzle ring 12 and the fourth surface 16*b* of the drive ring 16.

The base ends 15*a* of the nozzle link plates 15 are attached to the second ends 14*b* of the nozzle shafts 142. The base end 15*a* of each nozzle link plate 15 has a through hole 15*e* formed therein. The through hole 15*e* and the second end 14*b* of the nozzle shaft 142 are substantially rectangular. The second end 14*b* of the nozzle shaft 142 is attached to the nozzle link plate 15 by being inserted into the through hole 15*e*. The nozzle shaft 142 and the nozzle link plate 15 are fixed to each other in a circumferential direction about the axis X1 of the nozzle shaft 142.

The distal ends 15*b* of the nozzle link plates 15 are attached to the attachment portions 162 of the drive ring 16. The distal ends 15*b* of the nozzle link plates 15 are movable relative to the attachment portions 162 of the drive ring 16. That is, the distal ends 15*b* of the nozzle link plates 15 are capable of moving relative to the attachment portions 162 of the drive ring 16. The distal end 15*b* of each nozzle link plate 15 is disposed between the two attachment members of each attachment portion 162. The distal end 15*b* of the nozzle link plate 15 may be configured to fall out (disconnect) or otherwise to be moved inwardly in the radial direction from between the two attachment members of the attachment portion 162. The distal ends 15*b* of the nozzle link plates 15 are removably attachable to the attachment portions 162 of the drive ring 16. The distal ends 15*b* of the nozzle link plates 15 are loosely fitted to the attachment portions 162 of the drive ring 16. The distal ends 15*b* of the nozzle link plates 15 are fitted freely (with play) to the attachment portions 162 of the drive ring 16.

The distal ends 15*b* of the nozzle link plates 15 are rotatable to the attachment portions 162 of the drive ring 16. When the drive ring 16 rotates about the axis of rotation X as a result of receiving a driving force from outside (drive member 44 shown in FIG. 3), the distal ends 15*b* of the nozzle link plates 15 attached to the attachment portions 162 rotate along the circumferential direction with the rotation of the drive ring 16. Each nozzle link plate 15 thus rotates about the axis X1 of the nozzle shaft 142. When the nozzle link plate 15 rotates, the nozzle shaft 142 attached to the base end 15*a* of the nozzle link plate 15 rotates about the axis X1. Accordingly, the nozzle body 141 attached to the first end 14*a* of the nozzle shaft 142 rotates. The distal end 15*b* of the nozzle link plate 15 may be configured to slide in some examples, or may be configured not to slide in other examples, relative to the attachment portion 162 while moving along the circumferential direction with the rotation of the drive ring 16 when the drive ring 16 rotates about the axis of rotation X. In either example, a force from the drive ring 16 can be transmitted to the nozzle link plate 15. In an example in which the distal end 15*b* of the nozzle link plate 15 does not slide relative to the attachment portion 162, the distal end 15*b* of the nozzle link plate 15 may roll with respect to the attachment portion 162, for example, in a manner similar to a cycloidal gear.

Figure 6A:
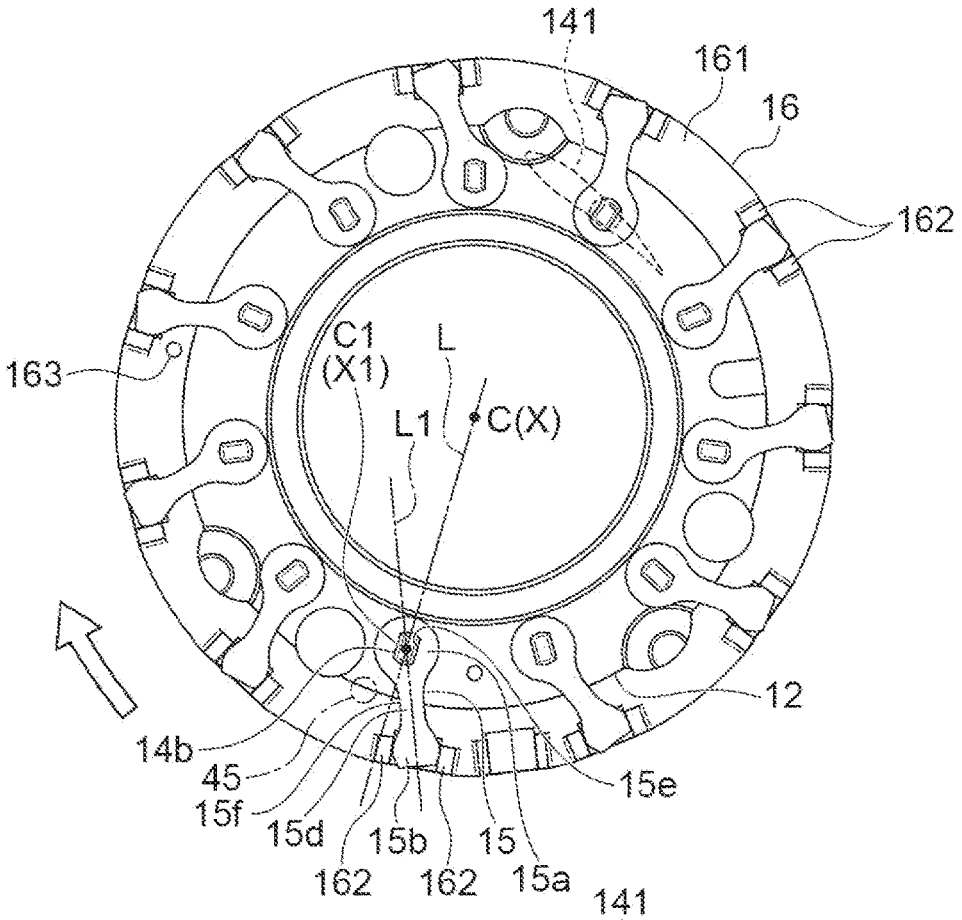
FIG. 6A is a diagram illustrating the example variable geometry mechanism of FIG. 2 in a fully closed state.
Figure 6B:
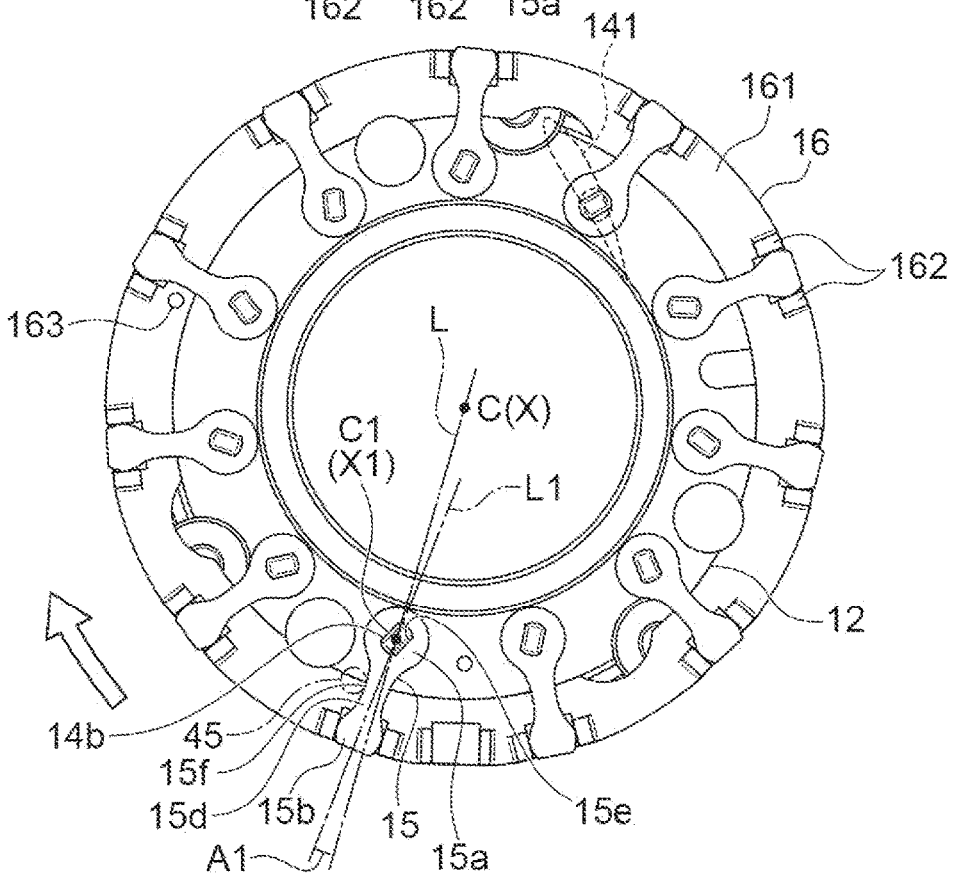
FIG. 6B is a diagram illustrating the example variable geometry mechanism of FIG. 2 in a fully opened state.

The functions of the fully open stopper 45 and the self-stopper 163 will next be described. FIGS. 6A and 6B show the variable geometry mechanism 10 attached to the bearing housing 4. As shown in FIG. 6A, when the variable geometry mechanism 10 is in a fully closed state, the nozzle link plates 15 do not abut against the fully open stopper 45 or the self-stopper 163. The fully closed state of the variable geometry mechanism 10 refers to a state in which the nozzle bodies 141 of adjacent nozzle vanes 14 abut one another and the connection channel S is blocked.

As shown in FIG. 6B, when the drive ring 16 rotates a predetermined angle in the circumferential direction, one of the nozzle link plates 15 abut against the fully open stopper 45. A side surface 15*f* of an intermediate portion between the base end 15*a* and the distal end 15*b* of that nozzle link plate 15 abuts against the fully open stopper 45. The variable geometry mechanism 10 at this time is in a fully opened state. When the variable geometry mechanism 10 is in the fully opened state, the nozzle link plate 15 is in a position rotated by a first angle about the axis X1 of the nozzle shaft 142 relative to a neutral position. The neutral position will now be described. Two imaginary lines are first defined. An imaginary line extending from the base end 15*a* of the nozzle link plate 15 toward the distal end 15*b* is referred to as a center line L1. An imaginary line connecting a center C of the variable geometry mechanism 10 (a point through which the axis of rotation X passes) and a center C1 of the nozzle shaft 142 (a point through which the axis X1 of the nozzle shaft 142 passes) is referred to as a neutral line L. The neutral position is a position of the nozzle link plate 15 when the center line L1 overlaps the neutral line L. That is, when the variable geometry mechanism 10 is in the fully opened state, an angle A1 between the center line L1 of the nozzle link plate 15 and the neutral line L is the first angle. The fully open stopper 45 thus regulates a moving range of the nozzle link plates 15.

When the drive ring 16 rotates a predetermined angle in the circumferential direction in a state in which the variable geometry mechanism 10 is not attached to the bearing housing 4 (see FIG. 4), one of the nozzle link plates 15 abut against the self-stopper 163. The side surface 15*f* of the intermediate portion between the base end 15*a* and the distal end 15*b* of that nozzle link plate 15 abuts against the self-stopper 163. At this time, the nozzle link plate 15 is in a position rotated by a second angle about the axis X1 of the nozzle shaft 142 relative to the neutral position. That is, at this time, an angle A2 between the center line L1 of the nozzle link plate 15 and the neutral line L is the second angle. The self-stopper 163 thus regulates the moving range of the nozzle link plates 15 when the variable geometry mechanism 10 is not attached to the bearing housing 4.

The moving range (for example, a second moving range from the neutral position) of the nozzle link plates that is regulated by the fully open stopper 45 is smaller than the moving range (for example, a first moving range from the neutral position) of the nozzle link plates 15 that is regulated by the self-stopper 163. That is, a relationship in which the angle A1 is smaller than the angle A2 is satisfied. When the drive ring 16 rotates in a state in which the variable geometry mechanism 10 is attached to the bearing housing 4, the nozzle link plates 15 abut against the fully open stopper 45 before abutting against the self-stopper 163. In the state in which the variable geometry mechanism 10 is attached to the bearing housing 4, the nozzle link plates 15 do not abut against the self-stopper 163. However, when the drive ring 16 rotates in the state in which the variable geometry mechanism 10 is not attached to the bearing housing 4, the nozzle link plates 15 abut against the self-stopper 163 before the distal ends 15*b* fall out of, or become disconnected from, the attachment portions 162.

As described above, in the variable geometry mechanism 10, the drive ring 16 is rotatable about the axis of rotation X of the nozzle ring 12. Additionally, the nozzle vanes 14 are attached to the nozzle ring 12. The nozzle shafts 142 of the nozzle vanes 14 are inserted through the bearing holes 12*c* of the nozzle ring 12. The second ends 14*b* of the nozzle shafts 142 project from the second surface 12*b*. The drive ring 16 has a plurality of attachment portions 162 that projects from the fourth surface 16*b*. The base ends 15*a* of the nozzle link plates 15 are attached to the second ends 14*b* of the nozzle shafts 142. The distal ends 15*b* of the nozzle link plates 15 are attached to the attachment portions 162. The distal ends 15*b* of the nozzle link plates 15 are movable relative to the attachment portions 162. When the drive ring 16 rotates about the axis of rotation X of the nozzle ring 12, the distal ends 15*b* of the nozzle link plates 15 attached to the attachment portions 162 move along the circumferential direction of the drive ring 16 with the rotation of the drive ring 16. The nozzle link plates 15 thus rotate about the axes X1 of the nozzle shafts 142. When the nozzle link plates 15 rotate, the nozzle shafts 142 attached to the base ends 15*a* of the nozzle link plates 15 rotate and the nozzle bodies 141 formed at the first ends 14*a* of the nozzle shafts 142 rotate. The drive ring 16 has the self-stopper 163 which projects from the fourth surface 16*b* and is disposed between one of the bearing holes 12*c* and one of the attachment portions 162 in the radial direction of the nozzle ring 12. Thus, when the rotation of the drive ring 16 exceeds a predetermined range, the nozzle link plates 15 abut against the self-stopper 163.

As a result, the rotation of the nozzle link plates 15 is regulated by the self-stopper 163 so that the nozzle link plates 15 remain in contact with the attachment portions 162 of the drive ring 16. Thus, handling of the variable geometry mechanism 10 is facilitated when, for example, attaching the variable geometry mechanism 10 to the bearing housing 4.

In the variable geometry mechanism 10, the attachment portions 162 of the drive ring 16 project from the fourth surface 16*b* of the body portion 161. Thus, compared to the mechanism disclosed in Unexamined Patent Publication No. 2006-177318 in which the ends of the nozzle link plates are fit into recesses formed on the inner circumferential surface of the drive ring, the outer diameter of the drive ring 16 can be reduced at least by the thickness of the drive ring in the radial direction that forms the recesses. Consequently, the drive ring 16 can be made smaller in the radial direction. Additionally, since the attachment portions 162 of the drive ring 16 project from the fourth surface 16*b* of the body portion 161, the self-stopper 163 can be formed on the body portion 161 of the drive ring 16 and not on the nozzle ring 12. This eliminates the need for a space in which to form the self-stopper 163 on the nozzle ring 12 and the outer diameter of the nozzle ring 12 becomes small. For examples in which the nozzle ring 12 has a thickness that is greater than the thickness of the drive ring 16, the weight can be reduced by reducing the outer diameter of the nozzle ring 12. Moreover, the strength of the drive ring 16 can be improved by reducing the inner diameter of the drive ring 16. When the outer diameter of the drive ring is small, further enhancements in space, weight, and/or strength may be realized.

The self-stopper 163 is integrally formed with the body portion 161 by half blanking the body portion 161 with a press. The number of components of the variable geometry mechanism 10 can thus be reduced.

The height H of the self-stopper 163 is less than the thickness T of the nozzle link plate 15. This suppresses a disconnection of the nozzle link plates 15 while reducing the weight of the device. Additionally, cost can be reduced by saving material.

The turbocharger 1 includes the variable geometry mechanism 10, and the bearing housing 4 to which the variable geometry mechanism 10 is attached. The bearing housing 4 includes the attachment surface 4*a* that faces the nozzle link plates 15 of the variable geometry mechanism 10, and the fully open stopper 45 that is formed on the attachment surface 4*a* and projects from the attachment surface 4*a*. The fully open stopper 45 regulates the moving range of the nozzle link plates 15. The moving range of the nozzle link plates 15 that is regulated by the fully open stopper 45 is smaller than the moving range of the nozzle link plates 15 that is regulated by the self-stopper 163. After the variable geometry mechanism 10 is attached to the bearing housing 4, the nozzle link plates 15 abut against the fully open stopper 45 before abutting against the self-stopper 163. The accuracy of position of the self-stopper 163 thus does not affect the function of the turbocharger 1. Consequently, the accuracy of position of the self-stopper 163 can be relaxed compared to the accuracy of position of the fully open stopper 45.

It is to be understood that not all aspects, advantages and features described herein may necessarily be achieved by, or included in, any one particular example. Indeed, having described and illustrated various examples herein, it should be apparent that other examples may be modified in arrangement and detail.

The bearing housing 4 need not have the fully open stopper 45. In some examples, the self-stopper 163 may also function as the fully open stopper 45.

In the variable geometry mechanism 10, the opening of the nozzle vanes 14 may be initialized by abutting the nozzle link plates 15 against the fully open stopper 45.

The self-stopper 163 may be formed separately from the body portion 161 of the drive ring 16. The self-stopper 163 may be fixed to the body portion 161, for example, by press-fitting or welding.

The self-stopper 163 may project more toward the sixth surface 15*d* than a position approximately halfway between the fifth surface 15*c* and the sixth surface 15*d* of the nozzle link plate 15. The self-stopper 163 may project from the sixth surface 15*d* of the nozzle link plate 15. The height H of the self-stopper 163 may be more than half the thickness T of the nozzle link plate 15. The height H of the self-stopper 163 may be equal to or more than the thickness T of the nozzle link plate 15.

The self-stopper 163 may have various shapes. The self-stopper 163 may be, for example, parallelepiped.

The invention claimed is:

1. A variable geometry mechanism comprising:

an annular nozzle ring;

a drive ring rotatable about a central axis of the nozzle ring, wherein the drive ring includes:

a plurality of attachment portions formed on a surface of the drive ring; and a self-stopper projecting from the surface of the drive ring on which the attachment portions are formed, wherein the self-stopper is located radially inward from the attachment portions so as to be closer to the central axis of the nozzle ring;

a plurality of nozzle vanes rotatably coupled to the nozzle ring and configured to vary a flow rate of the variable geometry mechanism in response to a rotation of the drive ring about the central axis of the nozzle ring; and a plurality of nozzle link plates extending from the nozzle ring to the drive ring, each of the plurality of nozzle link plates including a first end coupled to one of the plurality of nozzle vanes, and a second end coupled to one of the attachment portions of the drive ring, wherein the self-stopper is configured to exclusively abut against a first nozzle link plate among the plurality of nozzle link plates, to regulate a moving range of the first nozzle link plate during the rotation of the drive ring.

2. The variable geometry mechanism according to claim 1, wherein each of the attachment portions includes a first attachment member and a second attachment member separated from each other in a circumferential direction of the drive ring, and the self-stopper is disposed radially inward of the first attachment member.

3. The variable geometry mechanism according to claim 2, wherein the first attachment member is disposed upstream of the second attachment member in a rotation direction of the drive ring for opening the nozzle vanes.

4. The variable geometry mechanism according to claim 2, wherein the self-stopper has a diameter that is smaller than a separation length between the first attachment member and the second attachment member in the circumferential direction.

5. The variable geometry mechanism according to claim 2, wherein a diameter of the self-stopper equals a thickness of the first attachment member in the circumferential direction.

6. The variable geometry mechanism according to claim 2, wherein at least a portion of the self-stopper is radially aligned with the first attachment member when viewed from the central axis of the nozzle ring.

7. The variable geometry mechanism according to claim 1, wherein the nozzle ring includes a plurality of bearing holes in which nozzle axes of the nozzle vanes are disposed, and the self-stopper is disposed between one of the bearing holes and one of the attachment portions in a radial direction of the nozzle ring.

8. The variable geometry mechanism according to claim 1, wherein a radial length from the self-stopper to the one of the attachment portions is greater than a radial length from the self-stopper to an inner circumferential edge of the drive ring.

9. The variable geometry mechanism according to claim 1, wherein a distance from the surface of the drive ring to a distal end of the self-stopper is less than a thickness of the nozzle link plates in a direction that is parallel to the central axis of the nozzle ring.

10. The variable geometry mechanism according to claim 1, wherein a distance from the surface of the drive ring to a distal end of the self-stopper is less than a distance from the surface of the drive ring to distal ends of the attachment portions in a direction that is parallel to the central axis of the nozzle ring.

11. The variable geometry mechanism according to claim 1, wherein the nozzle link plates are configured to contact the attachment portions while the self-stopper is abutted against the first nozzle link plate.

12. The variable geometry mechanism according to claim 1, wherein the self-stopper is configured not to abut against the first nozzle link plate when the nozzle vanes are in a fully opened state.

13. The variable geometry mechanism according to claim 1, wherein a distal end of the self-stopper is configured to abut against a side surface of the first nozzle link plate.

14. The variable geometry mechanism according to claim 1, wherein the self-stopper has a cylindrical shape.

15. The variable geometry mechanism according to claim 1, wherein the self-stopper is integrally formed with the drive ring.

16. The variable geometry mechanism according to claim 1, wherein when the drive ring rotates, the self-stopper is configured to move from a first position in which the self-stopper is separated from the first nozzle link plate to a second position in which the self-stopper is abutted against the first nozzle link plate.

17. A turbocharger comprising:

the variable geometry mechanism of claim 1; and a bearing housing to which the variable geometry mechanism is attached, wherein the bearing housing includes an attachment surface facing the nozzle link plates of the variable geometry mechanism, and a fully open stopper projecting from the attachment surface, wherein the fully open stopper is configured to regulate the nozzle link plates within a moving range, and wherein the moving range of the nozzle link plates regulated by the fully open stopper is smaller than the moving range of the first nozzle link plate regulated by the self-stopper.

18. A variable geometry mechanism comprising:

an annular nozzle ring;

a drive ring rotatable about a central axis of the nozzle ring, wherein the drive ring includes:

a plurality of attachment portions formed on a surface of the drive ring; and a self-stopper projecting from the surface of the drive ring on which the attachment portions are formed, wherein the self-stopper has a cylindrical shape, and wherein the self-stopper is located radially inward from the attachment portions so as to be closer to the central axis of the nozzle ring;

a plurality of nozzle vanes rotatably coupled to the nozzle ring and configured to vary a flow rate of the variable geometry mechanism in response to a rotation of the drive ring about the central axis of the nozzle ring; and a plurality of nozzle link plates extending from the nozzle ring to the drive ring, each of the plurality of nozzle link plates including a first end coupled to one of the plurality of nozzle vanes, and a second end coupled to one of the attachment portions of the drive ring, wherein the self-stopper is configured to regulate a moving range of at least one of the nozzle link plates during the rotation of the drive ring.

19. The variable geometry mechanism according to claim 18, wherein the plurality of nozzle link plates includes a first nozzle link plate, and the self-stopper is configured to exclusively abut against the first nozzle link plate.

20. A variable geometry mechanism comprising:

an annular nozzle ring;

a drive ring rotatable about a central axis of the nozzle ring, wherein the drive ring includes:

a plurality of attachment portions formed on a surface of the drive ring; and a self-stopper projecting from the surface of the drive ring on which the attachment portions are formed, wherein the self-stopper is located radially inward from the attachment portions so as to be closer to the central axis of the nozzle ring;

a plurality of nozzle vanes rotatably coupled to the nozzle ring and configured to vary a flow rate of the variable geometry mechanism in response to a rotation of the drive ring about the central axis of the nozzle ring; and a plurality of nozzle link plates extending from the nozzle ring to the drive ring, each of the plurality of nozzle link plates including a first end coupled to one of the plurality of nozzle vanes, and a second end coupled to one of the attachment portions of the drive ring, wherein the self-stopper is configured to regulate a moving range of at least one of the nozzle link plates during the rotation of the drive ring, and wherein a distance from the surface of the drive ring to a distal end of the self-stopper is less than a thickness of the nozzle link plates in a direction that is parallel to the central axis of the nozzle ring.

* * * * *